US005424812A

United States Patent [19]

Kemmochi et al.

[11] Patent Number: 5,424,812

[45] Date of Patent: Jun. 13, 1995

[54] IMAGE FORMING APPARATUS HAVING DEVELOPER CARRYING MEMBER SUPPLIED WITH OSCILLATING VOLTAGE

[75] Inventors: Kazuhisa Kemmochi; Shigeru Ohki, both of Yokohama; Hiroyuki Suzuki, Tokyo, all of Japan

[73] Assignee: Canon Kabushiki Kaisha, Tokyo, Japan

[21] Appl. No.: 214,213

[22] Filed: Mar. 17, 1994

[30] Foreign Application Priority Data

Mar. 19, 1993 [JP] Japan ..... 5-085403

[51] Int. Cl.[6] ..... G03G 15/09

[52] U.S. Cl. ..... 355/251; 118/657

[58] Field of Search ..... 355/259, 251, 245; 118/653, 657, 658; 430/120, 122

[56] References Cited

U.S. PATENT DOCUMENTS

| | | | |
|---|---|---|---|
| 4,395,476 | 7/1983 | Kanbe et al. | 430/102 |
| 4,746,589 | 5/1988 | Haneda et al. | 430/102 |
| 4,904,558 | 2/1990 | Nagatsuka et al. | 430/122 |
| 5,003,351 | 3/1991 | Wakl et al. | 355/259 X |
| 5,250,382 | 10/1993 | Shimojo et al. | 430/109 |
| 5,257,075 | 10/1993 | Ohki | 355/246 |
| 5,310,615 | 5/1994 | Tanikawa | 430/106.6 |

FOREIGN PATENT DOCUMENTS

| | | |
|---|---|---|
| 60-154260 | 8/1985 | Japan . |
| 62-289858 | 12/1987 | Japan . |
| 4019677 | 1/1992 | Japan . |
| 4348367 | 12/1992 | Japan . |
| 2174317 | 11/1986 | United Kingdom . |

*Primary Examiner*—R. L. Moses

*Attorney, Agent, or Firm*—Fitzpatrick, Cella, Harper & Scinto

[57] ABSTRACT

An image forming apparatus includes an image bearing member for bearing an electrostatic latent image; developer carrying member for carrying a developer comprising toner particles; a voltage source for applying to the developer carrying member an oscillating voltage having a predetermined frequency; wherein the following is satisfied:

$$|Vpp-2Vcont|/16Vf^2<d^2/|Q|$$

where Vpp (V) is a peak-to-peak voltage of the oscillating voltage, Vf (Hz) is the frequency of the oscillating voltage, Vcont (V) is a potential difference between a voltage of a DC component of the oscillating voltage and a potential of an image portion on the image bearing member when a maximum image density is provided, Q (c/kg) is an average triboelectric charge amount of the toner particles, and d (m) is a gap between the image bearing member and the developer carrying member.

7 Claims, 10 Drawing Sheets

IMAGE FORMING APPARATUS HAVING DEVELOPER CARRYING MEMBER SUPPLIED WITH OSCILLATING VOLTAGE

FIELD OF THE INVENTION AND RELATED ART

The present invention relates to an image forming apparatus such as a copying machine, printer or the like, and more particularly to an image forming apparatus in which an electrostatic latent image is formed on a photosensitive member by selective actuation of a laser beam.

Recently, digital image formation is being used in the field of a copying machine or printer as a result of demand for full-color image or systematic arrangement. For example, a laser beam printer has been widely used in which a latent image bearing member is scanned with a laser beam, and a desired image is formed in the latent image bearing member (such as a photosensitive drum or the like) by selective actuation of the laser beam.

The typical usage of such laser beam printers is for binary level recording of characters, graphics or the like. In this case, the recording of dots, characters, graphics or the like does not require halftone level recording, and therefore, the structure of the printer is latter simple.

On the other hand, a printer capable of forming tone images in the binary level type. Such a printer using dithering method, density pattern method or the like, is known. However, as is well known, a high resolution image can not be obtained using the dithering method or the density pattern method.

Under the circumstances, a proposal has been made recently in which a halftone level dot is formed for each pixel without reducing the high recording density. This is done by modulating a pulse width (PWM) of the laser beam in accordance with the image signal. Using this method, high resolution and high tone reproduction image can be produced.

However, in a halftone region having a reflection density of not more than 0.3 in such an apparatus, roughness or white stripes appear in the image. The defects are not so notable in the case of characters, but they are much notable in a low density region in the case of photographic image or the like.

The investigations have been made as to the causes of the roughness.

In the case of using two component developer:

When a high light portion latent image is formed by latent image dots, the latent image on the photosensitive member is not a broad image as in analog latent image, if it is seen microscopically, but it is rather local images. If the density is further reduced, the latent image becomes dull because of the influence of the film thickness of the photosensitive member with the result of gradual decrease of the maximum contrast potential V0, as shown in FIG. 5. For example, if an attempt is made to reproduce an image having a reflection image density of approx. 0.2, the potential of the latent image V0 is approx. 150–200 V. In the case of a reverse-development, the surface potential of the non-image portion is 100–200 V higher than the DC component of the developing bias voltage to avoid the foggy background, and therefore, the potential difference Vcont from the DC component of the developing bias when the voltage V0 is 150–250 V, is 0–100 V, approx. The Vcont of 0–100 V means that the toner particles are placed under instable state, that is, they may be deposited onto the photosensitive member or onto the developing sleeve. For this reason, when the latent image is developed by the two component developer, the contacts state of a magnet brush is significantly influential to a development efficiency, and therefore, the image roughness occurs due to the missing of dots or the like corresponding to the non-uniformity of the magnetic brush.

The case of using non-magnetic one component developer:

The similar situation occurs when non-magnetic one component developer is used in place of the two component developer is used. When the high light latent image having the contrast potential difference Vcont of 0–100 V approx. (the toner particles are instable), the state of toner application on the developing roller is significantly influential to the development efficiency, and the white stripes and image roughness appears due to the missing of dots corresponding to the non-uniformity of the toner application of the developing roller.

In the developing device using the non-magnetic one component developer, the foggy background (deposition of the toner to the non-image zones on the photosensitive drum), easily occurs in the normal usage state. This is one of the defects of the conventional non-magnetic one component developing operation.

SUMMARY OF THE INVENTION

Accordingly, it is a principal object of the present invention to provide an image forming apparatus capable of forming a high density solid image without foggy background.

It is another object of the present invention to provide an image forming apparatus in which partial missing of the image in a high light zone is prevented.

According to an aspect of the present invention, there is provided an image forming apparatus, comprising: an image bearing member for bearing an electrostatic latent image; developer carrying member for carrying a developer comprising toner particles; voltage applying means for applying to the developer carrying member an oscillating voltage having a predetermined frequency; wherein the following is satisfied:

$$|Vpp-2Vcont|/16Vf^2<d^2/|Q|$$

where Vpp (V) is a peak-to-peak voltage of the oscillating voltage, Vf (Hz) is the frequency of the oscillating voltage, Vcont (V) is a potential difference between a voltage of a DC component of the oscillating voltage and a potential of an image portion on the image bearing member when a maximum image density is provided, Q (c/kg) is an average triboelectric charge amount of the toner particles, and d (m) is a gap between the image bearing member and the developer carrying member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 3:
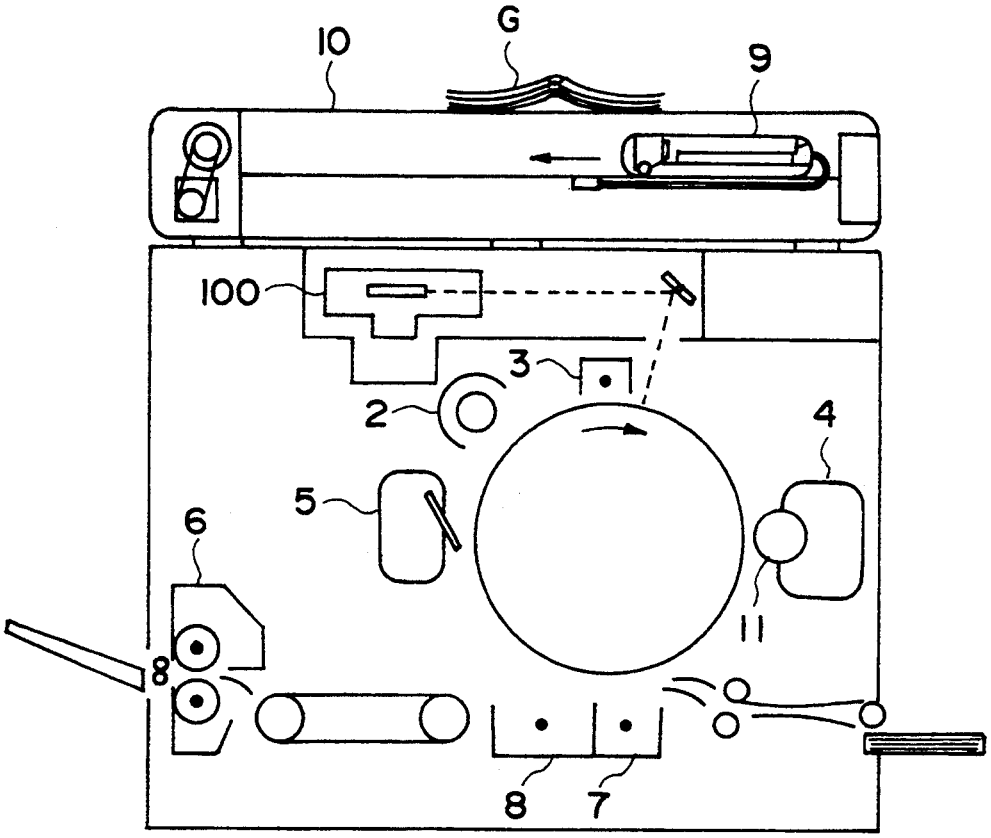
FIG. 3 is a sectional view of an electrophotographic copying apparatus of digital type usable with the present invention.

Referring to FIG. 3, there is shown an image forming apparatus according to an embodiment of the present invention. On an original supporting platen 10, an original G is placed face down. Subsequently, a copy switch is depressed to start the copying operation. The original G is illuminated and scanned by a unit 9 integrally having an original illumination lamp, a short-focus lens array and a CCD sensor. In the unit 9, the light reflected from the original is imaged by the short-focus lens array and is incident on the CCD sensor. The CCD sensor comprises a light receiving portion, a transfer portion and an output portion. The light receiving portion of the CCD element converts the light signal to an electric signal, which is transferred sequentially to an output portion in synchronism with clockpulses, by the transfer portion. In the output portion, the charge signal is converted to a voltage signal, which is amplified and reduced in impedance, and then is outputted. The analog signal thus produced is subjected to a known image processing operation, and is converted to a digital signal which is sent to the printer.

In the printer, an electrostatic latent image is formed in response to the image signal. A latent image bearing member in the form of an electrophotographic photosensitive drum 1 is rotated at a predetermined peripheral speed about a central axis, and is uniformly charged by the charger 3 to the positive or negative polarity. Subsequently, the uniformly charged surface of the photosensitive drum 1 is scanned with a laser beam modulated in accordance with the image signal, through a laser scanner 100, so that an electrostatic latent image is gradually formed corresponding to the original image, on the photosensitive drum 1.

Figure 4:
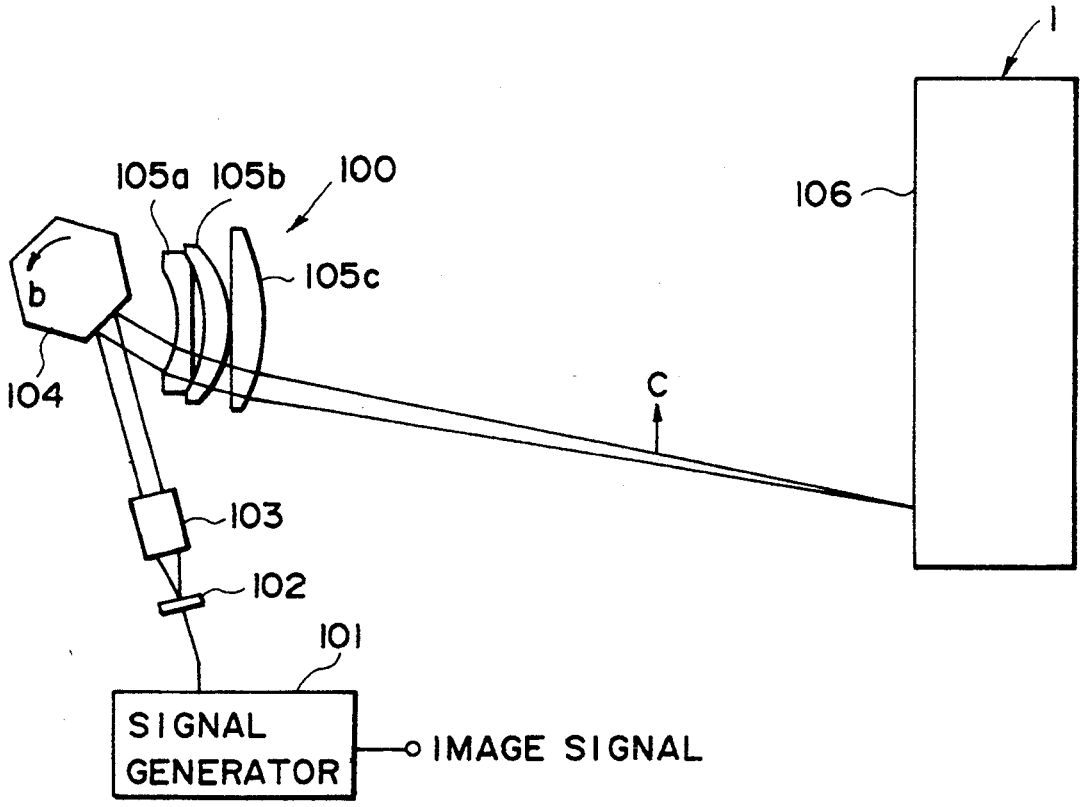
FIG. 4 illustrates a laser scanner used in the copying apparatus of FIG. 3.
Figure 5:
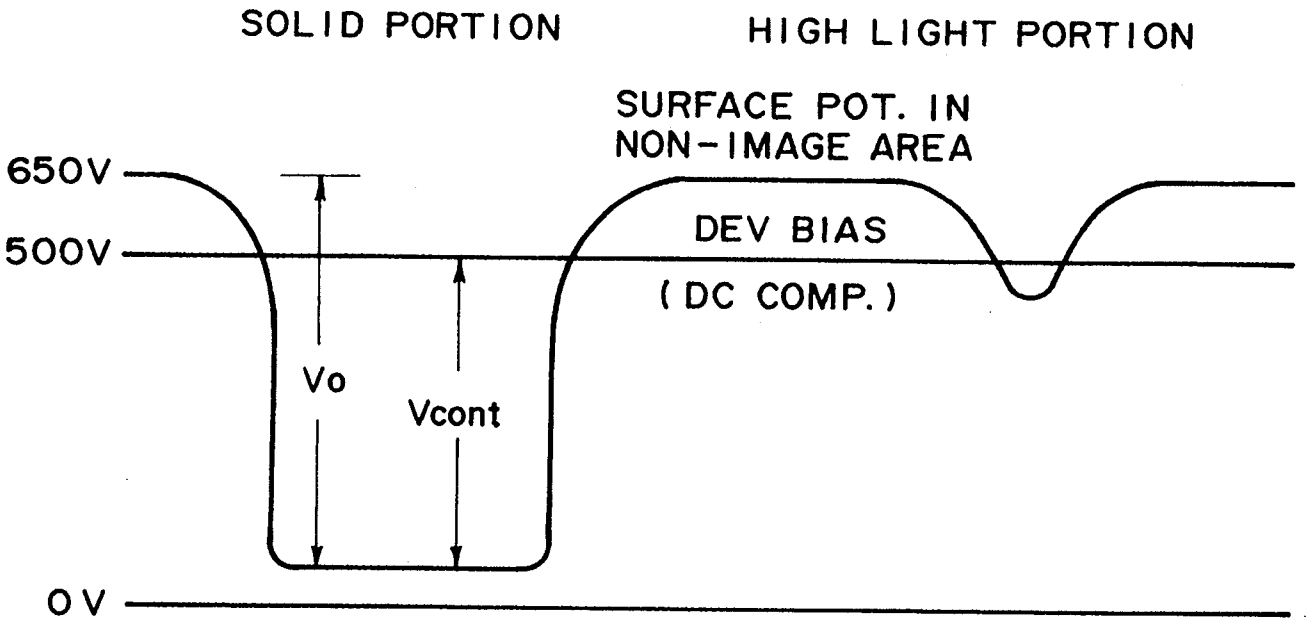
FIG. 5 is a graph of surface potential of the solid image portion and high light portion.
Figure 6:
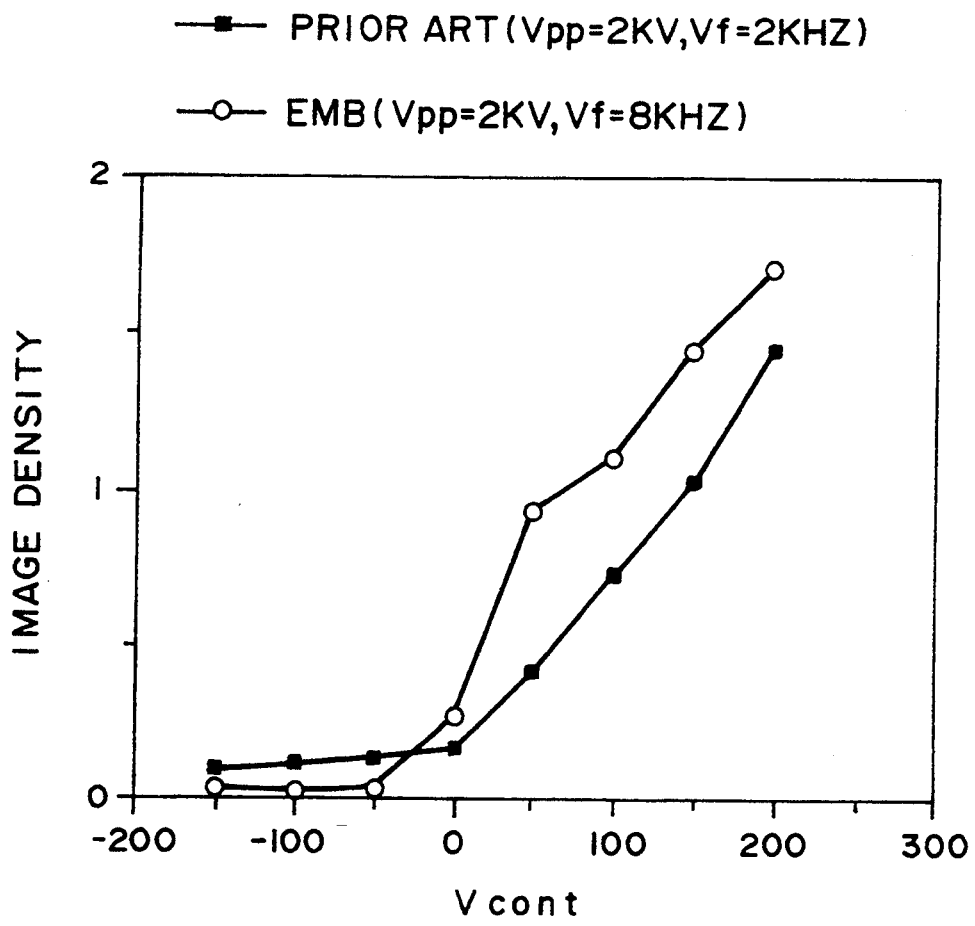
FIG. 6 is a graph of Vcont and image density in the case of analog latent image formation, with a conventional developing bias condition and a present invention bias condition.

Referring to FIG. 4, there is schematically shown the structure of the laser scanner 100. When the laser beam is deflected by the laser scanner 100, a solid laser element 102 is actuated or deactuated at predetermined timing by light signal generator 101 on the basis of the supplied image signal. The laser beam emitted from the solid laser element 102 is converted to an afocal beam by a collimator lens 103, and is deflected in the direction C by a rotatable polygonal mirror 104 rotating in the direction b, and is imaged as a spot on the surface to be scanned 106 of the photosensitive drum by the f-$\theta$ lens groups 105*a*, 105*b* and 105*c*.

By the laser beam scanning, an exposure distribution corresponding to one scanning line of the image is provided on the surface 106 of the photosensitive drum 1. The surface 106 is scrolled through a predetermined distance in a direction perpendicular to the scanning direction, by which an exposure distribution corresponding to the image signals, is provided on the surface 106 to be scanned.

The electrostatic latent image thus formed on the photosensitive drum is visualized into a toner image by a developing device 4.

Figure 1:
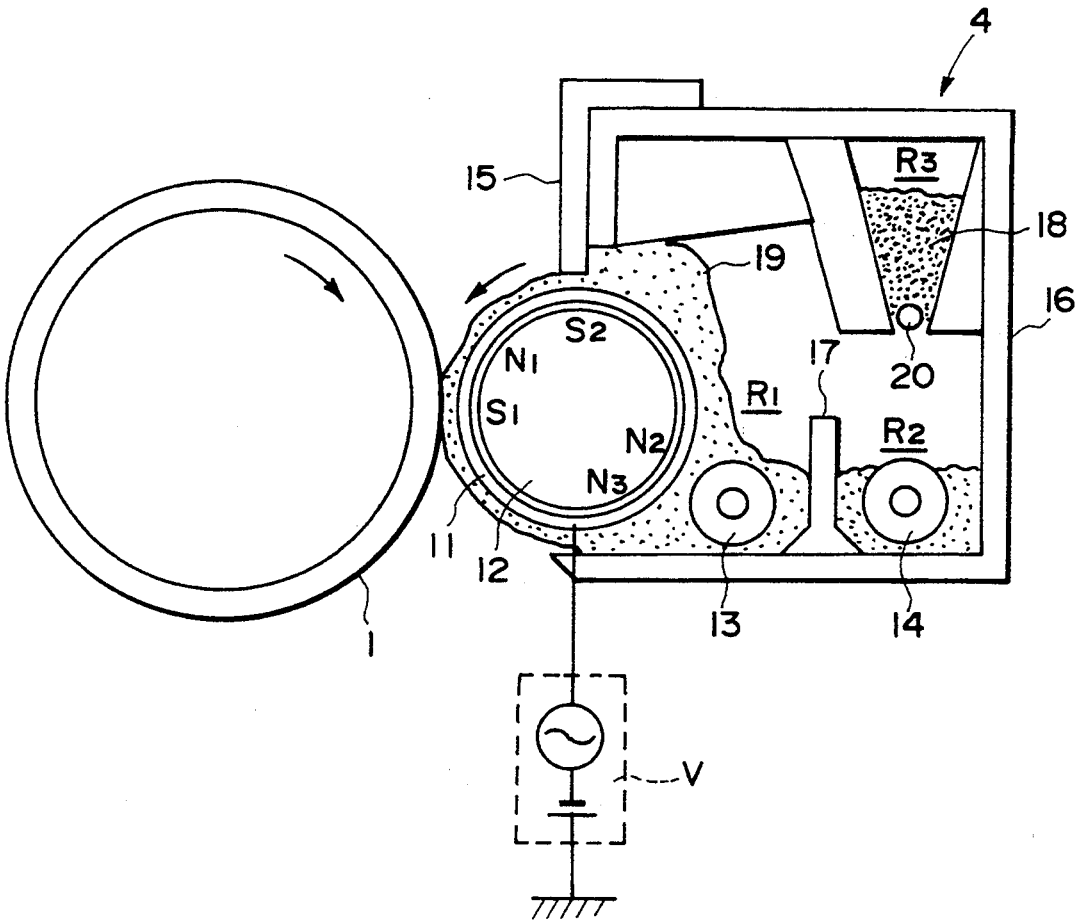
FIG. 1 is a sectional view of a developing apparatus using a two component developer usable with an image forming apparatus according to an embodiment of the present invention.

Referring to FIG. 1, the description will be made as to an exemplary image forming apparatus 4 using two component developer comprises toner particles and magnetic particles. The developing device 4 comprises a developer container 14 having an opening in which a developing sleeve 11 is rotatably supported to face the photosensitive drum 1. In the developing sleeve 11, a magnetic field generating means in the form of a magnet roller 12 having a plurality of magnetic poles is stationarily disposed. In the developer container 11, there are disposed stirring screws 13 and 14 and a regulating blade 15 for forming a thin layer of the developer on the developing sleeve surface. Designated by a reference V is a voltage source for applying an oscillating voltage to the developing sleeve 11.

Here, the description will be made as to the developing process and the circulation system of the developer for visualizing an electrostatic latent image through a two component magnetic brush using the above-described developing device 4.

With the rotation of the developing sleeve 11, the developer 19 taken up by the magnetic pole N2 of the magnet roller 12 is regulated by a regulating blade 15 extended substantially perpendicular to the surface of the developing sleeve 11, in the process of being conveyed from the pole N2 portion to the pole N1 portion, and it is formed as a thin layer on the developing sleeve 11. The developer in the form of the thin layer is conveyed to a main developing pole S1, where chains is formed by the magnetic force. The developer in the form of the chains is used to develop the electrostatic latent image. Thereafter, the developer on the developing sleeve 11 is returned into the developer container 16 by the repelling magnetic field provided by the magnetic poles N3 and N2.

The electrostatic latent image formed on the photosensitive drum 1 can be visualized by the developing apparatus 4 using the two component developer. However, it can be visualized by a developing apparatus using non-magnetic one component developer as the developer.

Figure 2:
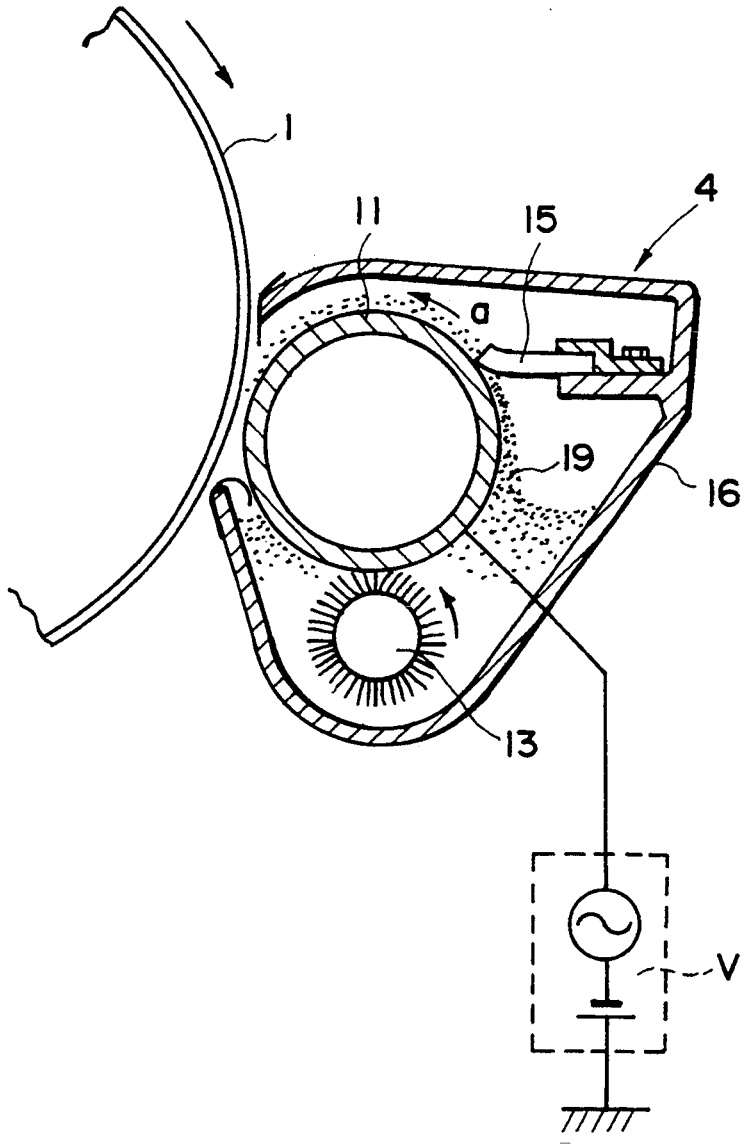
FIG. 2 is a sectional view of a developing apparatus using a non-magnetic one component developer usable with an image forming apparatus according to an embodiment of the present invention.

Referring to FIG. 2, there is shown an exemplary developing apparatus 4 using a non-magnetic one component developer as the developer. As compared with the developing apparatus using the two component developer described above, the developing apparatus of FIG. 2 is advantageous from the standpoint of the downsizing of the developing apparatus, and therefore, that of the entire image forming apparatus. In another developing apparatus, magnetic one component developer is used as the developer. The magnetic developer is required to contain therein magnetic material to acquire the magnetic property, with the result of poor image fixing of the toner image on a transfer sheet, and that the color reproducibility is poorer than the two component developer because of the magnetic material (usually magnetic material is black) is contained in the developer particles.

Referring to FIG. 2, the developing device 4 comprises a developer container 16 which contains non-magnetic one component developer comprising non-magnetic toner particles. The container 16 is provided with an opening in which a developing roller as a developer carrying member is rotatably supported therein to face the photosensitive drum 1. The developing roller 11 is in the form of a non-magnetic sleeve (aluminum, stainless steel or the like). In this embodiment, the developing roller 11 is rotated in a direction a by an unshown driving source. The surface of the developing roller 11 has unsmoothness of 2–5 μm to assure the carrying of the toner. The non-magnetic toner 12 is retained adjacent the bottom of the developer container 16, that is, below the developing roller 11, and is supplied onto the developing roller 11 by a take-up roller 14. The take-up roller 14 is also effective to stir the toner on the developing roller 11 after the developing action and the toner 19 in the developer container. The toner thus taken up on the developing roller is regulated while being triboelectrically charged, by an end of a rubber blade 15, and is applied on the developing roller 11.

The toner thus applied is transferred from the developing roller 11 onto the photosensitive drum 1 by a developing bias in the form of a superimposed alternating voltage and a DC voltage.

The toner image thus formed on the photosensitive drum 1 is electrostatically transferred onto a transfer material by a transfer charger 7, as shown in FIG. 3. Thereafter, the transfer material is electrostatically separated by a separation charger 8 and is fed into an image fixing device 6, where the transfer material is subjected to the heat-fixing operation. Thus, a print is produced.

The surface of the photosensitive drum 1, after the toner image transfer, is cleaned by a cleaner 5 so that the residual toner or another contamination is removed. Then, the photosensitive member is repeatedly usable for the image forming operation.

The description will be made as to a first embodiment using the two component developer, referring to FIG. 1.

Embodiment 1

The photosensitive drum 1 (latent image bearing member) has an outer diameter of 80 mm the inside of the developer container 16 of the developing device 4 is divided by a partition wall 17 into a developing chamber (first chamber) R1 and a stirring chamber (second chamber) R2. Above the stirring chamber R2, a toner container R3 is formed with a partition 17 therebetween. A developer 19 is contained in the developing chamber R1 and the stirring chamber R2. In the toner container R3, the toner (non-magnetic toner) 18 for supply is contained. The toner containing chamber R3 is provided with a supply opening 20, and the toner 18 is supplied into the stirring chamber R2, corresponding to the consumption of the toner, through the supply opening 20.

In the developing chamber R1, there is provided a feeding screw 13 which conveys the developer 19 in the developer chamber R1 in the direction of the length of the developing sleeve 11 by the rotation thereof. Similarly, a conveying screw 14 is provided in the containing chamber R2 to convey the toner supplied into the stirring chamber R2 through the supply opening 20 in the direction of the length of the developing sleeve 11, by the rotation thereof.

The developer 19 used in this embodiment is a two component developer containing non-magnetic toner and magnetic particles (carrier particles). The mixture ratio of the non-magnetic toner and the magnetic particles is such that the content by weight of the non-magnetic toner is approx. 5%. Here, the non-magnetic toner particles have a volume average particle size of approx. 8 μm. The magnetic particles are ferrite particles (maximum magnetization of 60 emu/g) coated with resin material. The weight average particle size is 50 μm. The particles have electric resistance of $10^8$ Ωcm or higher. The magnetic permeability of the magnetic particles is approx. 5.0.

The developer container 16 is provided with an opening at a position close to the photosensitive drum 1. A developing sleeve 11 is exposed through the opening, and the developing sleeve 11 is disposed with a space of 500 μm from the photosensitive drum 1. The outer diameter of the developing sleeve 11 of the non-magnetic material is 32 mm, and it is rotated at a peripheral speed of 280 mm/sec.

The magnetic field generating means in the form of a magnet roller (magnet 12) stationarily disposed in the developing sleeve 11 has a developing magnetic pole S1, a magnetic pole N3 disposed downstream thereof, and magnetic poles N2, S2 and N1 for conveying the developer 19. The magnet 12 is disposed within the developing sleeve 11 such that the developing magnetic pole S1 is faced to the photosensitive drum 1. The magnetic pole S1 is effective to form a magnetic field in the developing zone between the developing sleeve 11 and the photosensitive drum 1. The magnetic field functions to form a magnetic brush.

A regulating blade 15 is disposed above the developing sleeve 11 and functions to regulate the thickness of the developer 19 layer on the developing sleeve 11. It is made of non-magnetic material such as aluminum, SUS316 or the like. The gap between the developing blade 15 and the developing sleeve 11 is 800 μm in this embodiment.

The toner used are two kinds, i.e., the one having the triboelectric charge amount of approx. $2.0\times10^{-2}$ C/kg and the one having the triboelectric charge amount of approx. $3.0\times10^{-2}$ C/kg.

The method of measuring the triboelectric charge amount of the toner (two component developer) will be described, referring to FIG. 7.

The charge amount measuring device is provided with a measuring container 32 made of metal having a conductive screen 43 of 500 mesh at the bottom. The two component developer to be subjected to the measurement of the triboelectric charge amount is fed into a polyethylene bin having a capacity of 50–100 ml, and 0.5–1.5 g of the developer is pored into the measuring container 42, and the container is capped with a cap 44. The weight of the entire measuring container 42 is measured (W1 (kg)). A measuring container 42 is placed on a sucking machine 41 in which at least a portion in contact with the measuring container 42 is insulative. The toner is sucked through the sucking port 47, and a control valve 36 is actuated to provide 250 mmAq of the vacuum gauge 45. With this state, the sucking operation is continued for a sufficient period of time, preferably, for 2 minutes, thus removing the toner resin material. A potential difference is measured by a potentiometer 49 connected in series with the capacitor (capacitance C (F)) 48 between the measuring container 42 and the ground. The lead thereof is V. After the sucking operation, the weight of the entirety of the measuring container 42 is measured (W2 (kg)). The triboelectric charge amount of the toner is calculated as follows:

$$\text{triboelectric charge amount of toner } (C/kg) = C \times V \times 10^{-3}/(W1 - W2)$$

In this embodiment, high light half tone image having the image density of approx. 0.2 and a solid image are produced, and the evaluation is made on the basis of the smoothness of the high light half tone image and the density of the solid image. The electrostatic latent image forming conditions are as follows.

The photosensitive drum 1 is uniformly charged to 650 V by a charger 3 when a high light half tone image is to be produced, the PWM exposure (pulse width modulation) is carried out with the semiconductor laser to reduce the surface potential to approx. 450 V. On the other hand, when the solid image is formed, it is reduced to approx. 100 V (Vcont=400 V). In this embodiment, the latent image is visualized through reverse-development. Subsequently, the developing step will be described.

By the developing device 4 shown in FIG. 1, the developing sleeve 11 carries the developer 11 at a position adjacent to the magnetic pole N2, and with the rotation of the developing sleeve 11, the developer 19 is fed to the developing zone. When the developer 19 reaches to the neighborhood of the developing zone, the magnetic particles of the developer 19 form chains by the magnetic force of the magnetic pole S1, which erect from the developing sleeve 11 to form a magnetic brush of the developer 19. The free ends of the magnetic brush rub the surface of the photosensitive drum 1. By the application of the voltage in the form of an AC biased DC voltage (500 V) between the developing sleeve 11 and the photosensitive drum 1, so that the toner on the magnetic brush is deposited to the latent image portion of the photosensitive drum 1.

In this embodiment, the amplitude Vpp of the alternating voltage component is fixed to 2000 V, and the frequency Vf is changed for the toner having the triboelectric charge amount of approx. $2.0 \times 10^{-2}$ C/kg and the toner having the triboelectric charge amount of approx. $3.0 \times 10^{-2}$ C/kg, with the above-described latent image forming conditions. The produced images are evaluated. As a result, as will be understood from Table 1 below, both of the high density in the solid image and the reproducibility in the high light region, were satisfactory only when A<B.

TABLE 1

| Tribo. | Vf (Hz) | Solid image | High light image | A $\frac{\lvert Vpp - 2\,Vcont\rvert}{16\,Vf^2}$ | B $\frac{d^2}{Q}$ |
|---|---|---|---|---|---|
| $2.0 \times 10^{-2}$ C/kg | 1000 | 1.58 | N | $7.5 \times 10^{-5} >$ | $1.3 \times 10^{-5}$ |
| | 2000 | 1.60 | F | $1.9 \times 10^{-5} >$ | $1.3 \times 10^{-5}$ |
| | 4000 | 1.68 | G | $4.7 \times 10^{-6} <$ | $1.3 \times 10^{-5}$ |
| | 8000 | 1.78 | E | $1.2 \times 10^{-6} <$ | $1.3 \times 10^{-5}$ |
| $3.0 \times 10^{-2}$ C/kg | 1000 | 1.50 | N | $7.5 \times 10^{-5} >$ | $8.3 \times 10^{-6}$ |
| | 2000 | 1.52 | F | $1.9 \times 10^{-5} >$ | $8.3 \times 10^{-6}$ |
| | 4000 | 1.60 | G | $4.7 \times 10^{-6} <$ | $8.3 \times 10^{-6}$ |

TABLE 1-continued

| Tribo. | Vf (Hz) | Solid image | High light image | A $\frac{\lvert Vpp - 2\,Vcont\rvert}{16\,Vf^2}$ | B $\frac{d^2}{Q}$ |
|---|---|---|---|---|---|
| | 8000 | 1.75 | G | $1.2 \times 10^{-6} <$ | $8.3 \times 10^{-6}$ |

N: No good
F: Fair
G: Good
E: Excellent

Here, the significant of A<B will be described. FIG. 8 shows forces applied to one toner particle on the developing sleeve 11. In the Figure, q is a charge amount; m is a mass; a is an acceleration; V is a potential difference between the photosensitive drum and the developing sleeve 11; d is a gap between the photosensitive drum 1 and the developing sleeve 11.

An alternating voltage is applied to the toner from the developing sleeve 11 for 1/(2 Vf) (sec) in each period. The distance X through which the toner can move during this is:

$$X = \frac{1}{2} a \left(\frac{1}{2V_f}\right)^2 = \frac{1}{2}\left(\frac{|q|}{m} \cdot \frac{\Delta V}{d}\right)\frac{1}{4V_f^2} = \frac{1}{2}|Q| \cdot \frac{\Delta V}{d} \cdot \frac{1}{4V_f^2} = \frac{|Q| \cdot \Delta V}{8d \cdot V_f^2} \quad (1)$$

The distance X through which the toner can move from the developing sleeve 11 toward the photosensitive drum 1 is:

$$X_+ = \frac{|Q| \cdot \left|\frac{1}{2} V_{pp} + V_{cont}\right|}{8d \cdot V_f^2} \quad (2)$$

On the other hand, the distance X through which the toner can move from the photosensitive drum 1 toward the developing sleeve 11 is:

$$X_- = \frac{|Q| \cdot \left|\frac{1}{2} V_{pp} - V_{cont}\right|}{8d \cdot V_f^2} \quad (3)$$

If the distance X− movable in one period of the removing voltage is not enough for the toner to return from the photosensitive drum 1 to the developing sleeve 11, then X+>X− is satisfied, by which the toner reciprocates toward the photosensitive drum 1. This is satisfied by the distance X− smaller than the gap d between the photosensitive drum 1 and the developing sleeve 11, as follows:

$$\frac{|Q| \cdot \left|\frac{1}{2} V_{pp} - V_{cont}\right|}{8d \cdot V_f^2} < d \rightarrow \frac{|V_{pp} - 2V_{cont}|}{16V_f^2} < \frac{d^2}{|Q|} \quad (4)$$

If the developing operation is carried out under this condition, the missing dot does not occur even if the voltage V0 is 150–250 V. By the repetition of the reciprocation adjacent the photosensitive drum 1, the toner particles are concentrated on the part of the latent image, so that each dot is reproduced faithfully, and therefore, a uniform halftone image without non-uniformity depending on the state of contacts with the magnetic brush chains, can be produced.

In the non-image portion, the surface potential is normally slightly higher than the DC component of the developing bias voltage as in this embodiment, in order to remove the fog. For this reason, in the non-image portion, Vcont in equations (2) and (3), are negative, and therefore $X+<X-$ is satisfied. Therefore, the toner particles are reciprocated toward the developing sleeve, so that the fog is hardly formed.

Embodiment 2

In Embodiment 1, the use is made with the non-magnetic toner having an average particle size of approx. 8 μm and magnetic particles of ferrite particles (maximum magnetization of 60 emu/g) coated with resin materials and having a weight average particle size of 50 μm. They are mixed with the weight ratio of 5:95. In the present embodiment, the average particle size of the non-magnetic toner is approx. 5 μm, and the magnetic particles are of ferrite particles (maximum magnetization of 60 emu/g) coated with the resin material and having a weight average particle size of 30 μm. They are mixed at a weight ratio of 4.5:95.5. Two triboelectric charge amounts, i.e., approx. $2.0\times10^{-2}$ c/kg and approx. $3.0\times10^{-2}$ c/kg, are prepared by changing amount of external addition materials as in Embodiment 1. The experiments of this embodiment are carried out under the same conditions as with Embodiment 1 except for the developer.

Similar to the first embodiment, the evaluations are made on the basis of the smoothness of a high light halftone image having the image density of approx. 0.2 and on the image density of a solid image.

As a result, similarly to the first embodiment, only when $A<B$ is satisfied, both of the high image density in the solid image and the satisfactory reproducibility of the high light portion, are satisfied, as will be understood from Table 2. As regards the high light portion, the smooth image could be produced as a result of the use of the smaller toner particle size.

TABLE 2

| Tribo. | Vf (Hz) | Solid image | High light image | A $\frac{\lvert Vpp - 2\,Vcont\rvert}{16\,Vf^2}$ | | B $\frac{d^2}{Q}$ |
|---|---|---|---|---|---|---|
| $2.0\times10^{-2}$ c/kg | 1000 | 1.55 | F | $7.5\times10^{-5}$ | > | $1.3\times10^{-5}$ |
| | 2000 | 1.57 | F | $1.9\times10^{-5}$ | > | $1.3\times10^{-5}$ |
| | 4000 | 1.64 | G | $4.7\times10^{-6}$ | < | $1.3\times10^{-5}$ |
| | 8000 | 1.72 | E | $1.2\times10^{-6}$ | < | $1.3\times10^{-5}$ |
| $3.0\times10^{-2}$ c/kg | 1000 | 1.47 | N | $7.5\times10^{-5}$ | > | $8.3\times10^{-6}$ |
| | 2000 | 1.50 | F | $1.9\times10^{-5}$ | > | $8.3\times10^{-6}$ |
| | 4000 | 1.58 | G | $4.7\times10^{-6}$ | < | $8.3\times10^{-6}$ |
| | 8000 | 1.69 | E | $1.2\times10^{-6}$ | < | $8.3\times10^{-6}$ |

N: No good
F: Fair
G: Good
E: Excellent

Embodiment 3

This embodiment is different from the first embodiment in that the average particle size of the non-magnetic toner is approx. 8 μm, that the magnetic particles are ferrite particles (maximum magnetization of 60 emu/g) coated with resin material and having an average particle size of 30 μm and that they are mixed at the weight ratio of 7:93. Two triboelectric charge amounts, i.e., $2.0\times10^{-2}$ c/kg and approx. $3.0\times10^{-2}$ c/kg, are prepared by changing amounts of external addition materials.

In this embodiment, the toner content ratio can be increased as compared with Embodiment 1, and therefore, the development efficiency is improved, and therefore, the voltage Vcont is 350 V. In other words, the primary charging potential is 600 V, and the voltage Vdc (the DC component of the developing bias voltage) is 450 V. Except for these conditions, the same conditions as with Embodiment 1 are used.

Similar to the first embodiment, the evaluations are made on the basis of the smoothness of a high light halftone image having the image density of approx. 0.2 and on the image density of a solid image. As a result, similarly to the first embodiment, only when $A<B$ is satisfied, both of the high image density in the solid image and the satisfactory reproducibility of the high light portion, are satisfied, as will be understood from Table 3. Because the amount of the toner existing on the developing sleeve is increased, and therefore, the non-uniformity of contact of chains of the developer does hardly occur, and therefore, smoother images can be produced in the high light portion.

TABLE 3

| Tribo. | Vf (Hz) | Solid image | High light image | A $\frac{\lvert Vpp - 2\,Vcont\rvert}{16\,Vf^2}$ | | B $\frac{d^2}{Q}$ |
|---|---|---|---|---|---|---|
| $2.0\times10^{-2}$ c/kg | 1000 | 1.60 | N | $8.1\times10^{-5}$ | > | $1.3\times10^{-5}$ |
| | 2000 | 1.65 | F | $2.0\times10^{-5}$ | > | $1.3\times10^{-5}$ |
| | 4000 | 1.72 | G | $5.1\times10^{-6}$ | < | $1.3\times10^{-5}$ |
| | 8000 | 1.83 | E | $1.3\times10^{-6}$ | < | $1.3\times10^{-5}$ |
| $3.0\times10^{-2}$ c/kg | 1000 | 1.54 | N | $8.1\times10^{-5}$ | > | $8.3\times10^{-6}$ |
| | 2000 | 1.57 | F | $2.0\times10^{-5}$ | > | $8.3\times10^{-6}$ |
| | 4000 | 1.64 | G | $5.1\times10^{-6}$ | < | $8.3\times10^{-6}$ |
| | 8000 | 1.80 | E | $1.3\times10^{-6}$ | < | $8.3\times10^{-6}$ |

N: No good
F: Fair
G: Good
E: Excellent

Embodiment 4

In Embodiments 1-3, a voltage in the form of a DC voltage continuously superimposed with an alternating voltage is applied between the developing sleeve 11 and the photosensitive drum 1, by which the toner on the magnetic brush is transferred and deposited onto the latent image portion of the photosensitive drum 1. In the present embodiment, a voltage superimposed with an intermittent alternating voltage, is applied, by which the toner on the magnetic brush is transferred onto and deposited on the latent image portion of the photosensitive drum 1. As the developer, similarly to the first embodiment, the average particle size of the non-magnetic toner is 8 μm, and the magnetic particles are of ferrite particles (maximum magnetization of 60 emu/g) coated with the resin material and having an average particle size of 50 μm. They are mixed at the weight ratio of 5:95.

In this embodiment, the DC voltage is 500 V, and the amplitude Vpp of the alternating voltage intermittently applied is fixed at 200 V, and the frequency Vf is changed. The triboelectric charge amounts of the toner are approx. $2.0\times10^{-2}$ c/kg and approx. $3.0\times10^{-2}$ c/kg. With these latent image forming conditions, the produced images are evaluated. The time period in which the alternating voltage is not applied is one period for each one period of the alternating voltage, as shown in FIG. 9, (A).

As a result, as will be understood from Table 4 below, only when A<B is satisfied, both of the high density of the solid image and the satisfactory reproducibility of the high light image, are satisfied.

TABLE 4

| Tribo. | Vf (Hz) | Solid image | High light image | A $\frac{\lvert Vpp - 2\,Vcont\rvert}{16\,Vf^2}$ | | B $\frac{d^2}{Q}$ |
|---|---|---|---|---|---|---|
| $2.0 \times 10^{-2}$ c/kg | 1000 | 1.55 | N | $7.5 \times 10^{-5}$ | > | $1.3 \times 10^{-5}$ |
| | 2000 | 1.58 | F | $1.9 \times 10^{-5}$ | > | $1.3 \times 10^{-5}$ |
| | 4000 | 1.64 | E | $4.7 \times 10^{-6}$ | < | $1.3 \times 10^{-5}$ |
| | 8000 | 1.75 | E | $1.2 \times 10^{-6}$ | < | $1.3 \times 10^{-5}$ |
| $3.0 \times 10^{-2}$ c/kg | 1000 | 1.48 | N | $7.5 \times 10^{-5}$ | > | $8.3 \times 10^{-6}$ |
| | 2000 | 1.51 | F | $1.9 \times 10^{-5}$ | > | $8.3 \times 10^{-6}$ |
| | 4000 | 1.61 | G | $4.7 \times 10^{-6}$ | < | $8.3 \times 10^{-6}$ |
| | 8000 | 1.74 | E | $1.2 \times 10^{-6}$ | < | $8.3 \times 10^{-6}$ |

N: No good
F: Fair
G: Good
E: Excellent

The significance of A<B has been described in conjunction with FIG. 8, regarding Embodiment 1. In this embodiment, if the developing operation is performed under the condition defined by the above-described equations (1)–(4), the toner is not sufficiently capable of reciprocating between the developing sleeve and the photosensitive drum in the one period of the alternating voltage when the voltage V0 is 150–250 V approximately. In addition, when the alternating voltage is stopped, the DC component functions to attract to the photosensitive drum such an amount of the toner as corresponds to the latent image potential, and therefore, the dot missing defect can be avoided. This phenomenon is more remarkable than when the alternating voltage is continuously applied as in Embodiment 1.

By the intermittent repetition of the reciprocation, the toner is concentrated on the latent image portion so that each dot is faithfully reproduced without the non-uniformity due to the state of contact with the magnetic brush, in halftone images. The image thus produced is better than those produced in accordance with Embodiment 1.

In the non-image portion, the surface potential is normally slightly higher than the DC component of the developing bias voltage as in this embodiment in order to avoid the fog. For this reason, the voltage Vcont in equations (2) and (3) is negative in the non-image portion, and therefore X+<X− is satisfied. In addition, the alternating voltage is stopped, and therefore, the DC component functions to attract the toner toward the developing sleeve, and therefore, the toner particles are deviated toward the developing sleeve, and therefore, the fog is further reduced.

In this embodiment, the alternating voltage applied is as shown in FIG. 9, (A), but the present invention is not limited to this. For example, as shown in FIG. 9, (B), two-period application with 5-period rest, or as shown in FIG. 9, (C), one period-on and 10 period-rest, is usable. In this embodiment, rectangular waveform is used, which, however, may be replaced with a triangular waveform, sine waveform or the like. Most suitable application can be selected properly by one skilled in the art in accordance with the copying speed or developing conditions.

A ratio of the bias application period and the rest period is preferably 1:(½)–1:15.

Embodiment 5

In this embodiment, as contrasted to Embodiment 4, the average particle size of the non-magnetic toner is approx. 5 μm, and the magnetic particles are of ferrite particles (maximum magnetization of 60 emu/g) coated with resin materials. It has a weight average particle size of 30 μm. They are mixed at the weight ratio of 4.5:95.5. For the triboelectric charge amounts, similarly to Embodiment 4, approx. $2.0 \times 10^{-2}$ c/kg and approx. $3.0 \times 10^{-2}$ c/kg, are used. These different triboelectric charge amounts are provided by changing amount of external addition material.

Similar to the first embodiment, the evaluations are made on the basis of the smoothness of a high light halftone image having the image density of approx. 0.2 and on the image density of a solid image.

As a result, similarly to the fourth embodiment, only when A<B is satisfied, both of the high image density in the solid image and the satisfactory reproducibility of the high light portion, are satisfied, as will be understood from Table 4. Particularly in the high light portion, smoother images can be produced than Embodiment 4, because of the reduction of the toner particle size.

TABLE 5

| Tribo. | Vf (Hz) | Solid image | High light image | A $\frac{\lvert Vpp - 2\,Vcont\rvert}{16\,Vf^2}$ | | B $\frac{d^2}{Q}$ |
|---|---|---|---|---|---|---|
| $2.0 \times 10^{-2}$ c/kg | 1000 | 1.53 | F | $7.5 \times 10^{-5}$ | > | $1.3 \times 10^{-5}$ |
| | 2000 | 1.56 | G | $1.9 \times 10^{-5}$ | > | $1.3 \times 10^{-5}$ |
| | 4000 | 1.66 | E | $4.7 \times 10^{-6}$ | < | $1.3 \times 10^{-5}$ |
| | 8000 | 1.73 | UE | $1.2 \times 10^{-6}$ | < | $1.3 \times 10^{-5}$ |
| $3.0 \times 10^{-2}$ C/kg | 1000 | 1.45 | N | $7.5 \times 10^{-5}$ | > | $8.3 \times 10^{-6}$ |
| | 2000 | 1.52 | F | $1.9 \times 10^{-5}$ | > | $8.3 \times 10^{-6}$ |
| | 4000 | 1.60 | E | $4.7 \times 10^{-6}$ | < | $8.3 \times 10^{-6}$ |
| | 8000 | 1.68 | E | $1.2 \times 10^{-6}$ | < | $8.3 \times 10^{-6}$ |

N: No good
F: Fair
G: Good
E: Excellent
UE: Ultra-excellent

Embodiment 6

As is different from Embodiment 4, the average particle size of the non-magnetic toner in this embodiment is approx. 8 μm, and the magnetic particles are ferrite particles (maximum magnetization of 60 emu/g) coated with the resin material. It has an weight average particle size of 30 μm. They are mixed at the weight ratio of 7:93, thus providing a developer. The triboelectric charge amounts used are approx. $2.0 \times 10^{-2}$ c/kg and approx. $3.0 \times 10^{-2}$ c/kg as in Embodiment 1. The different charge amounts are provided by changing the amount of external addition material.

In this embodiment, the toner content can be increased as compared with Embodiment 4. Therefore, the development efficiency is improved, and Vcont is selected to be 350 V. The primary charging potential is 600 V, and Vdc (DC component of the developing bias voltage) is 450 V. As regards the other conditions, the similar conditions in Embodiment 4 are used.

Similar to the first embodiment, the evaluations are made on the basis of the smoothness of a high light halftone image having the image density of approx. 0.2 and on the image density of a solid image. As a result, similarly to the first embodiment, only when A<B is satisfied, both of the high image density in the solid image and the satisfactory reproducibility of the high light portion, are satisfied, as will be understood from Table 6. Because of the increase of the amount of the toner existing on the developing sleeve, the non-uniformity of the contacts with the chains of the developer does not easily occur, and therefore, the high light portion of the image is smoother than in Embodiment 5.

TABLE 6

| Tribo. | Vf (Hz) | Solid image | High light image | A $\frac{\lvert Vpp - 2\,Vcont\rvert}{16\,Vf^2}$ | B $\frac{d^2}{Q}$ |
|---|---|---|---|---|---|
| $2.0 \times 10^{-2}$ c/kg | 1000 | 1.62 | F | $8.1 \times 10^{-5} >$ | $1.3 \times 10^{-5}$ |
| | 2000 | 1.66 | G | $2.0 \times 10^{-5} >$ | $1.3 \times 10^{-5}$ |
| | 4000 | 1.74 | E | $5.1 \times 10^{-6} <$ | $1.3 \times 10^{-5}$ |
| | 8000 | 1.81 | E | $1.3 \times 10^{-6} <$ | $1.3 \times 10^{-5}$ |
| $3.0 \times 10^{-2}$ c/kg | 1000 | 1.52 | N | $8.1 \times 10^{-5} >$ | $8.3 \times 10^{-6}$ |
| | 2000 | 1.56 | F | $2.0 \times 10^{-5} >$ | $8.3 \times 10^{-6}$ |
| | 4000 | 1.67 | E | $5.1 \times 10^{-6} <$ | $8.3 \times 10^{-6}$ |
| | 8000 | 1.81 | E | $1.3 \times 10^{-6} <$ | $8.3 \times 10^{-6}$ |

N: No good
F: Fair
G: Good
E: Excellent

The description will be made as to a developing apparatus using one component developer shown in FIG. 2.

Embodiment 7

In this embodiment, one non-magnetic one component developer is charged to the triboelectric charge amount of approx. $2.0\times10^{-2}$ c/kg, and the other is charged to approx. $3.0\times10^{-2}$ c/kg.

High light half tone images having the image density of approx. 0.2 and a solid image are produced. The evaluations have been made on the basis of the smoothness of the high light halftone image and the image density of the solid image. Here, the electrostatic latent image formation for producing the image is as follows.

First, the photosensitive drum is uniformly charged to −650 V by a charger. When a high light halftone image is to be produced, a PWM exposure (pulse width modulation) is effected using a semiconductor laser to decrease the surface potential to approx. 450 V. On the other hand, when a solid image is to be produced, the surface potential is decreased to approx. 300 V (Vcont =200 V). In this embodiment, the developing operation was a reverse-development operation. The developing process will be described.

In the developing apparatus having the structure shown in FIG. 2, a developing bias voltage in the form of a superimposed DC voltage of 500 V and an alternating voltage is applied between a developing roller 11 and the photosensitive drum 1, by which the toner on the developing roller 11 is transferred and deposited to the latent image portion of the photosensitive drum 1. In this embodiment, the amplitude Vpp of the alternating voltage is fixed at 2000 V, and the frequency Vf is changed. The images are produced and evaluated under the above-described latent image forming conditions using the two developers charged to approx. $2.0\times10^{-2}$ c/kg and approx. $3.0\times10^{-2}$ c/kg.

Figure 7:
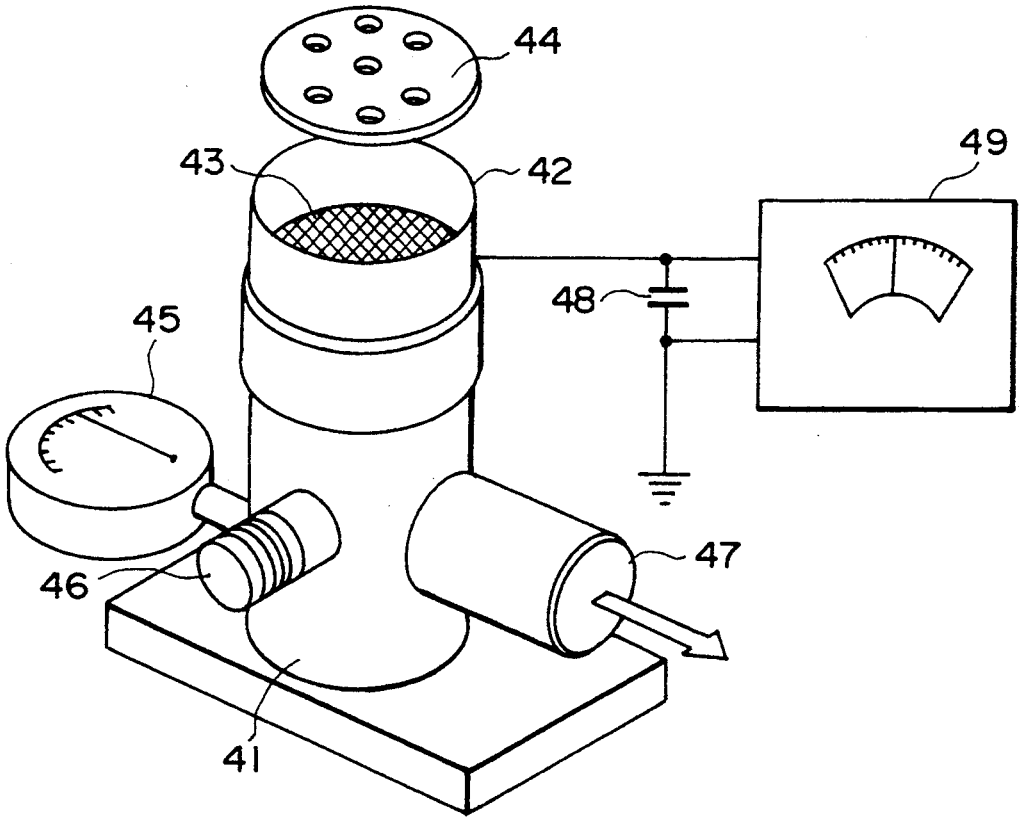
FIG. 7 is a perspective view of an apparatus for measuring triboelectric charge amount of the two component developer.

As will be understood from FIG. 7, only when A<B is satisfied, both of the high image density in the solid image and the satisfactory reproducibility of the high light image, are accomplished.

TABLE 7

| Tribo. | Vf (Hz) | Solid image | High light image | A $\frac{\lvert Vpp - 2\,Vcont\rvert}{16\,Vf^2}$ | B $\frac{d^2}{Q}$ |
|---|---|---|---|---|---|
| $2.0 \times 10^{-2}$ c/kg | 1000 | 1.46 | N | $1.0 \times 10^{-4} >$ | $1.3 \times 10^{-5}$ |
| | 2000 | 1.52 | G | $2.5 \times 10^{-5} >$ | $1.3 \times 10^{-5}$ |
| | 3000 | 1.58 | E | $1.1 \times 10^{-5} <$ | $1.3 \times 10^{-5}$ |
| | 4000 | 1.65 | E | $6.3 \times 10^{-6} <$ | $1.3 \times 10^{-5}$ |
| $3.0 \times 10^{-2}$ c/kg | 1000 | 1.41 | N | $1.0 \times 10^{-4} >$ | $8.3 \times 10^{-6}$ |
| | 2000 | 1.47 | F | $2.5 \times 10^{-5} >$ | $8.3 \times 10^{-6}$ |
| | 3000 | 1.54 | G | $1.1 \times 10^{-5} <$ | $8.3 \times 10^{-6}$ |
| | 4000 | 1.63 | E | $6.3 \times 10^{-6} <$ | $8.3 \times 10^{-6}$ |

N: No good
F: Fair
G: Good
E: Excellent

Figure 10A:
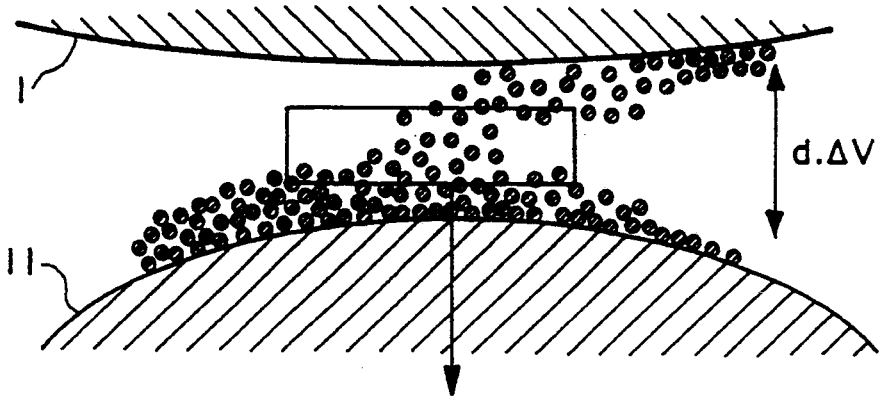
FIG. 10 shows forces applied to the toner in the case of non-magnetic one component developer.

Here, the significant of A<B will be described. FIG. 10 shows forces applied to one toner particle on the developing sleeve. In the Figure, q is a charge amount; m is a mass; a is an acceleration; ΔV is a potential difference between the photosensitive drum and the developing sleeve 11; d is a gap between the photosensitive drum 1 and the developing sleeve 11.

An alternating voltage is applied to the toner from the developing sleeve 11 for 1/(2 Vf) (sec) in each period. The distance X through which the toner can move during this is:

$$X = \frac{1}{2}a\left(\frac{1}{2V_f}\right)^2 = \frac{1}{2}\left(\frac{|q|}{m}\cdot\frac{\Delta V}{d}\right)\frac{1}{4V_f^2} = \frac{1}{2}|Q|\cdot\frac{\Delta V}{d}\cdot\frac{1}{4V_f^2} = \frac{|Q|\cdot\Delta V}{8d\cdot V_f^2} \tag{5}$$

The distance X through which the toner can move from the developing sleeve 11 toward the photosensitive drum 1 is:

$$X_+ = \frac{|Q|\cdot\left|\frac{1}{2}V_{pp} + V_{cont}\right|}{8d\cdot V_f^2} \tag{6}$$

On the other hand, the distance X through which the toner can move from the photosensitive drum 1 toward the developing sleeve 11 is:

$$X_- = \frac{|Q|\cdot\left|\frac{1}{2}V_{pp} - V_{cont}\right|}{8d\cdot V_f^2} \tag{7}$$

If the distance X− movable in one period of the removing voltage is not enough for the toner to return from the photosensitive drum 1 to the developing sleeve 11, then X+>X− is satisfied, by which the toner reciprocates toward the photosensitive drum 1. This is satisfied by the distance X− smaller than the gap d between the photosensitive drum 1 and the developing sleeve 11, as follows:

$$\frac{|Q|\cdot\left|\frac{1}{2}V_{pp} - V_{cont}\right|}{8d\cdot V_f^2} < d \rightarrow \frac{|V_{pp} - 2V_{cont}|}{16V_f^2} < \frac{d^2}{|Q|} \tag{8}$$

If the developing operation is carried out under this condition, the missing dot does not occur even if the voltage V0 is 150–250 V. By the repetition of the reciprocation adjacent the photosensitive drum 1, the toner particles are concentrated on the part of the latent image, so that each dot is reproduced faithfully, and therefore, a uniform halftone image without non-uniformity depending on the state of contacts with the magnetic brush chains, can be produced.

In the non-image portion, the surface potential is normally slightly higher than the DC component of the developing bias voltage as in this embodiment, in order to remove the fog. For this reason, in the non-image portion, Vcont in equations (6) and (7), are negative, and therefore $X+<X-$ is satisfied. Therefore, the toner particles are reciprocated toward the developing sleeve, so that the fog is hardly formed.

Embodiment 8

In Embodiment 7, a voltage in the form of a DC voltage continuously superimposed with an alternating voltage is applied between the developing roller and the photosensitive drum 1, by which the toner on the magnetic brush is transferred and deposited onto the latent image portion of the photosensitive drum 1. In the present embodiment, a voltage superimposed with an intermittent alternating voltage, is applied, by which the toner on the magnetic brush is transferred onto and deposited on the latent image portion of the photosensitive drum 1.

In this embodiment, the DC voltage is 500 V, and the amplitude Vpp of the alternating voltage intermittently applied is fixed at 200 V, and the frequency Vf is changed. The triboelectric charge amounts of the toner are approx. $2.0\times10^{-2}$ c/kg and approx. $3.0\times10^{-2}$ c/kg. With these latent image forming conditions, the produced images are evaluated. The time period in which the alternating voltage is not applied is one period for each one period of the alternating voltage, as shown in FIG. 9, (A).

As a result, as will be understood from Table 8 below, only when $A<B$ is satisfied, both of the high density of the solid image and the satisfactory reproducibility of the high light image, are satisfied.

TABLE 8

| Tribo. | Vf (Hz) | Solid image | High light image | A $\frac{\lvert Vpp - 2\,Vcont\rvert}{16\,Vf^2}$ | | B $\frac{d^2}{Q}$ |
|---|---|---|---|---|---|---|
| $2.0\times10^{-2}$ c/kg | 1000 | 1.44 | N | $1.0\times10^{-4}$ | > | $1.3\times10^{-5}$ |
| | 2000 | 1.54 | G | $2.5\times10^{-5}$ | > | $1.3\times10^{-5}$ |
| | 3000 | 1.59 | E | $1.1\times10^{-5}$ | < | $1.3\times10^{-5}$ |
| | 4000 | 1.61 | E | $6.3\times10^{-6}$ | < | $1.3\times10^{-5}$ |
| $3.0\times10^{-2}$ C/kg | 1000 | 1.40 | N | $1.0\times10^{-4}$ | > | $8.3\times10^{-6}$ |
| | 2000 | 1.44 | F | $2.5\times10^{-5}$ | > | $8.3\times10^{-6}$ |
| | 3000 | 1.52 | G | $1.1\times10^{-5}$ | < | $8.3\times10^{-6}$ |
| | 4000 | 1.60 | E | $6.3\times10^{-6}$ | < | $8.3\times10^{-6}$ |

N: No good
F: Fair
G: Good
E: Excellent

The significance of $A<B$ has been described in conjunction with FIG. 10, regarding Embodiment 7. In this embodiment, if the developing operation is performed under the condition defined by the above-described equations (5)–(8), the toner is not sufficiently capable of reciprocating between the developing sleeve and the photosensitive drum in the one period of the alternating voltage when the voltage V0 is 150–250 V approximately. In addition, when the alternating voltage is stopped, the DC component functions to attract to the photosensitive drum such an amount of the toner as corresponds to the latent image potential, and therefore, the dot missing defect can be avoided.

By repetition of intermittent oscillation on the photosensitive drum, the toner particles are concentrated on the latent image portion, so that each dot is faithfully reproduced, and therefore, uniform halftone image can be produced even at the portion short of toner supply from the developing roller 11. The images thus produced are better than the images produced in accordance with Embodiment 7.

In the non-image portion, the surface potential is normally slightly higher than the DC component of the developing bias voltage as in this embodiment in order to avoid the fog. For this reason, the voltage Vcont in equations (6) and (7) is negative in the non-image portion, and therefore $X+<X-$ is satisfied. In addition, the alternating voltage is stopped, and therefore, the DC component functions to attract the toner toward the developing sleeve, and therefore, the toner particles are deviated toward the developing sleeve, and therefore, the fog is further reduced.

In this embodiment, the alternating voltage applied is as shown in FIG. 9, (A), but the present invention is not limited to this. For example, as shown in FIG. 9, (B), two-period application with 5-period rest, or as shown in FIG. 9, (C), one period-on and 10 period-rest, is usable. In this embodiment, rectangular waveform is used, which, however, may be replaced with a triangular waveform, sine waveform or the like. Most suitable application can be selected properly by one skilled in the art in accordance with the copying speed or developing conditions.

A ratio of the bias application period and the rest period is preferably 1:($\frac{1}{2}$)–1:15.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member for bearing an electrostatic latent image;

developer carrying member for carrying a developer comprising toner particles;

voltage applying means for applying to said developer carrying member an oscillating voltage having a predetermined frequency;

wherein the following is satisfied:

$$|Vpp-2Vcont|/16Vf^2<d^2/|Q|$$

where Vpp (V) is a peak-to-peak voltage of the oscillating voltage, Vf (Hz) is the frequency of the oscillating voltage, Vcont (V) is a potential difference between a voltage of a DC component of the oscillating voltage and a potential of an image portion on said image bearing member when a maximum image density is provided, Q (c/kg) is an average triboelectric charge amount of the toner particles, and d (m) is a gap between said image bearing member and said developer carrying member.

2. An apparatus according to claim 1, wherein the toner particles are non-magnetic particles.

3. An apparatus according to claim 1, wherein said developer carrying member comprises a magnetic field generating means, and the developer comprises magnetic particles in addition to the toner particles.

4. An apparatus according to claim 1, wherein the oscillating voltage includes a DC component and an AC component superimposed thereto, and the AC component is not superimposed for every predetermined intervals.

5. An apparatus according to claim 1, wherein the image portion is a low potential image portion of said image bearing member.

6. An apparatus according to claim 5, wherein said image bearing member comprises a photosensitive layer, and is exposed to light spot which is selectively rendered on and off in accordance with an image signal.

7. An apparatus according to claim 1, wherein the oscillating voltage has a rectangular waveform.

* * * * *

UNITED STATES PATENT AND TRADEMARK OFFICE

CERTIFICATE OF CORRECTION

PATENT NO. : 5,424,812

DATED : June 13, 1995

INVENTOR(S) : KAZUHISA KEMMOCHI, ET AL.

It is certified that error appears in the above-indentified patent and that said Letters Patent is hereby corrected as shown below:

On the title page item,

[56] Foreign Patent Documents

"4019677 1/1992 Japan
4348367 12/1992 Japan" should read
--4-19677 1/1992 Japan
4-348367 12/1992 Japan--.

Column 1

Line 27, "latter" should read --rather--.
Line 28, "tone" should read --toner--.
Line 29, "type. Such" should read --type, such as--.
Line 30, "dithering" should read --a dithering--.
Line 34, "the" should read --these--.
Line 45, "much" should read --very--.
Line 46, "of" should read --of a--.
Line 47, "The investigations" should read --Investigations--.
Line 48, "the" should read --this--.
Line 49, "two" should read --a two--; and "developer:" should read --developer, the following has been found.--.
Line 52, "analog" should read --an analog--.
Line 54, "the" (second occurrence) should read --then the--.
Line 57, "of" should read --in--.
Line 60, "0.2, the" should read --0.2, then the--.
Line 64, "the" should read --a--.
Line 68, "under instable" should read --in an unstable--.

UNITED STATES PATENT AND TRADEMARK OFFICE

CERTIFICATE OF CORRECTION

PATENT NO. : 5,424,812 Page 2 of 9

DATED : June 13, 1995

INVENTOR(S) : KAZUHISA KEMMOCHI, ET AL.

It is certified that error appears in the above-indentified patent and that said Letters Patent is hereby corrected as shown below:

Column 2

Line 4, "contacts" should read --contact--.
Line 9, "The" should read --In the--.
Line 10, "veloper:" should read --veloper, the following has been found.--.
Line 11, "The" should read --A--.
Line 13, "is used" should be deleted.
Line 15, "approx." should read --approx. is used--; and "instable)," should read --unstable),--.
Line 18, "appears" should read --appear--.
Line 23, "the" should read --a--.
Line 25, "drum)," should read --drum)--.
Line 35, "miss-" should read --voids in--.
Line 36, "ing of" should be deleted.
Line 38, "apparatus, comprising:" should read --apparatus comprising--.
Line 40, "developer" should read --a developer--.
Line 41, "voltage" should read --and voltage--.

Column 3

Figure 8A:
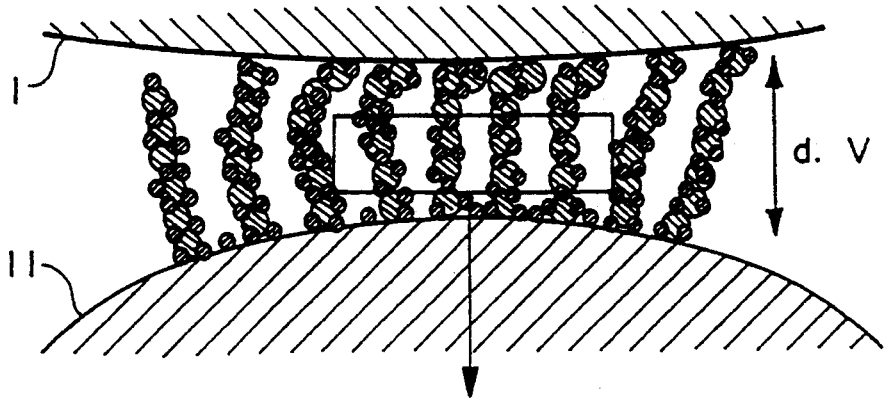
FIG. 8 illustrates forces applied to the toner in the case of two component developer.
Figure 8B:
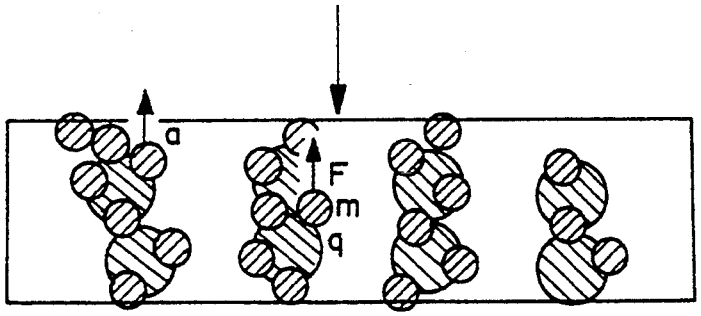
Figure 9A:
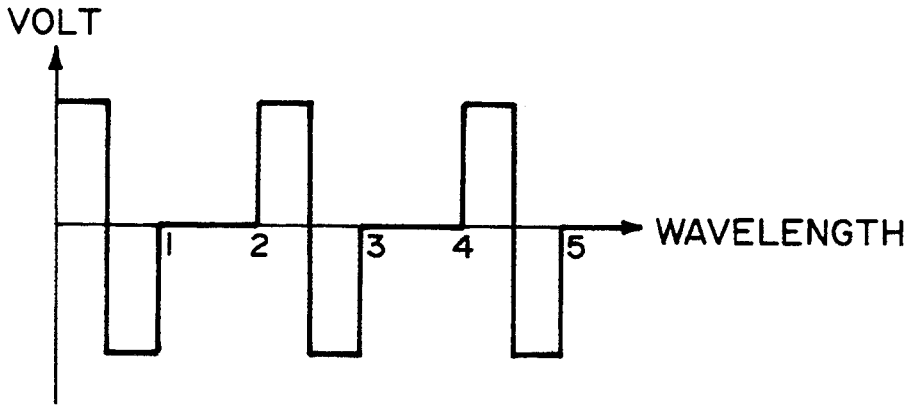
FIG. 9 is a waveform of a developing bias voltage according to an embodiment of this invention.
Figure 9B:
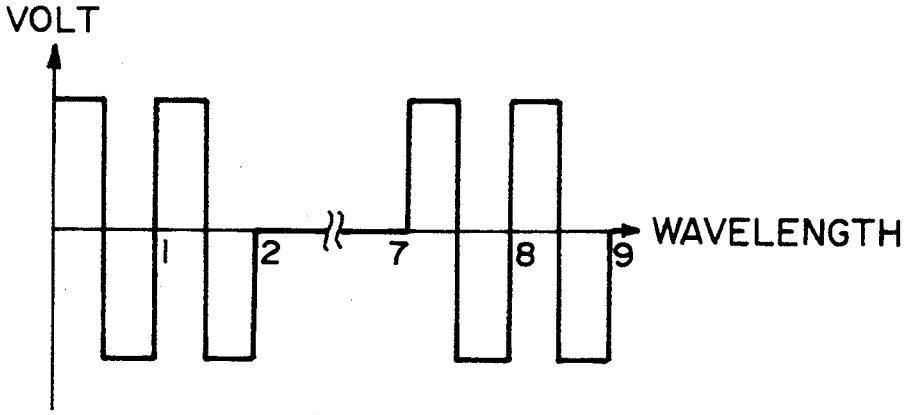
Figure 9C:
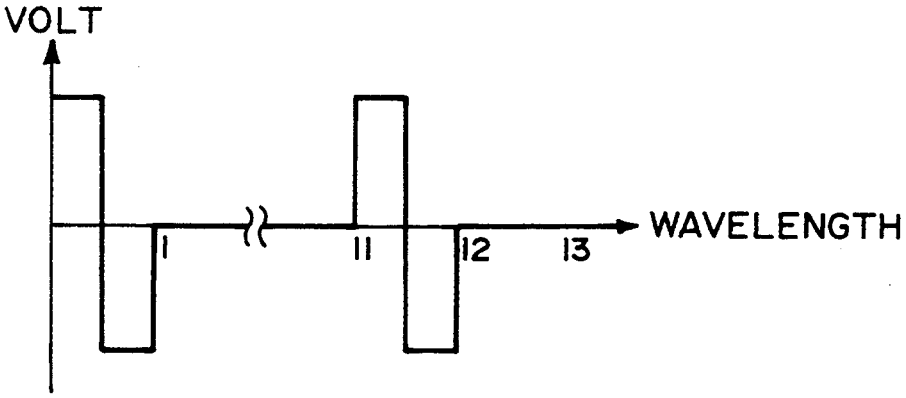
Figure 10B:
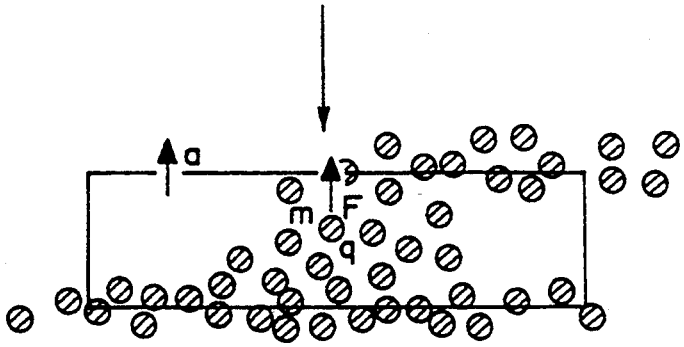

Line 19, "FIG. 8" should read --FIG. 8A--.
Line 21, INSERT: --Figure 8B is an enlarged view of a portion of Figure 8A.--
Line 21, "FIG. 9 is" should read --FIGS. 9A to 9C are--.
Line 23, "FIG. 10" should read --FIG. 10A--.
Line 25, INSERT: --Figure 10B is an enlarged view of a portion of Figure 10A.--.
Line 42, "clockpulses," should read --clock pulses,--.

UNITED STATES PATENT AND TRADEMARK OFFICE

CERTIFICATE OF CORRECTION

PATENT NO. : 5,424,812

DATED : June 13, 1995

INVENTOR(S) : KAZUHISA KEMMOCHI, ET AL.

It is certified that error appears in the above-indentified patent and that said Letters Patent is hereby corrected as shown below:

Column 4

Line 16, "the description will be made as" should be deleted.
Line 17, "to" should be deleted.
Line 18, "comprises" should read --comprising--.
Line 19, "particles" should read --particles will be described.--
Line 25, "container 11," should read --container 14,--.
Line 44, "is" should read --are--.

Column 5

Line 17, "unsmoothness" should read --a roughness--.
Line 22, "14" (both occurrences) should read --13--.
Line 39, "the" should read --a--.
Line 42, "another" should read --other--.
Line 51, "80mm the" should read --80mm, and the--.
Line 62, "corresponding" should read --in accordance with--.
Line 63, "to" should de deleted.

UNITED STATES PATENT AND TRADEMARK OFFICE

CERTIFICATE OF CORRECTION

PATENT NO. : 5,424,812

DATED : June 13, 1995

INVENTOR(S) : KAZUHISA KEMMOCHI, ET AL.

It is certified that error appears in the above-indentified patent and that said Letters Patent is hereby corrected as shown below:

Column 6

Line 46, "are" should read --comprises--; "the one" should read --one--; and "the" (last occurrence) should read --a--.

Line 48, "the one" should read --one--; and "the" (last occurrence) should read --a--.

Line 52, "described, referring" should read --described, with reference--.

Line 54, "container 32" should read --container 42--.

Line 59, "pored" should read --poured--.

Line 62, "A measuring" should read --Measuring--.

Line 66, "valve 36" should read --valve 46--.

Line 67, "vacuum gauge 45." should read --vacuum, measured by gauge 45.--; and "with" should read --In--.

Column 7

Line 1, "ably," should read --ably--.

Line 3, "the" should read --a--.

Line 13, "high" should read --a high--.

Line 14, "the" should read --an--.

Line 15, "the" (first occurrence) should read --an--.

Line 21, "the" should read -- a --.

Line 29, "By" should read --In--.

Line 35, "to" should be deleted.

Line 38, "erect" should read --stand erect--.

Line 41, "the voltage" should read --a voltage--.

Line 43, "so that" should be deleted.

Line 44, "to" should read --on--.

Line 54, "of" should be deleted.

UNITED STATES PATENT AND TRADEMARK OFFICE

CERTIFICATE OF CORRECTION

PATENT NO. : 5,424,812 Page 5 of 9

DATED : June 13, 1995

INVENTOR(S) : KAZUHISA KEMMOCHI, ET AL.

It is certified that error appears in the above-indentified patent and that said Letters Patent is hereby corrected as shown below:

Column 8

Line 11, "significant" should read --significance--; and FIG." should read --FIGS.--.
Line 12, "8 shows" should read --8A and 8B show--.
Line 13, "Figure," should read --Figures,--.
Line 21, "this" should read --this time--.
Line 64, "the" (first occurrence) should read --then the--; and "dot" should read --dot phenomenon--.
Line 65, "the" (first occurrence) should be deleted.
Line 67, "the" (first occurrence) should read --a--.

Column 9

Line 14, "the use" should read --use--; and "with the" should read --of a--.
Line 25, "c/kg" should read --C/kg--.
Line 26, "c/kg;" should read --C/kg,--.
Line 32, "the" (second occurrence) should be deleted.
Line 34, "the" should read --an--.
Table 2, "c/kg" (both occurrences) should read --C/kg--.
Line 68, "c/kg" should read --C/kg--; and "c/kg," should read --C/kg--.

Column 10

Line 11, "the" (second occurrence) should be deleted.
Line 20, "and therefore," should be deleted.
Line 21, "does" should be deleted.
Line 22, "occur," should read --occurs,--.
Table 3, "c/kg" (both occurrences) should read --C/kg--.

UNITED STATES PATENT AND TRADEMARK OFFICE

CERTIFICATE OF CORRECTION

PATENT NO. : 5,424,812 Page 6 of 9

DATED : June 13, 1995

INVENTOR(S) : KAZUHISA KEMMOCHI, ET AL.

It is certified that error appears in the above-indentified patent and that said Letters Patent is hereby corrected as shown below:

Column 10

Line 65, "c/kg" should read --C/kg--.
Line 66, "c/kg." should read --C/kg.--

Column 11

Line 2, "FIG. 9,(A)." should read --FIG. 9A.--
Line 4, "of" (first occurrence) should be deleted.
Line 6, "image," should read --image--.
Table 4, "c/kg" (both occurrences) should read --C/kg--.
Line 28, "the" should read --then the--.
Line 59, "FIG. 9,(A)," should read --FIG. 9A,--.
Line 60, "FIG. 9,(B)," should read --FIG. 9B,--.
Line 62, "FIG. 9,(C)," should read --FIG. 9C,--.
Line 63, "rectangular" should read --a rectangular--.
Line 65, "Most" should read --The most--.

Column 12

Line 12, "c/kg" should read --C/kg--.
Line 13, "c/kg," should read --C/kg--.
Line 14, "amount" should read --the amount--.
Line 16, "the" (second occurrence) should be deleted.
Line 18, "the" should read --an--.
Line 21, "of should be deleted.
Line 24, "Table 4." should read --Table 5.--
Line 25, "produced than" should read --produced in the present embodiment than in--.

UNITED STATES PATENT AND TRADEMARK OFFICE

CERTIFICATE OF CORRECTION

PATENT NO. : 5,424,812 Page 7 of 9

DATED : June 13, 1995

INVENTOR(S) : KAZUHISA KEMMOCHI, ET AL.

It is certified that error appears in the above-indentified patent and that said Letters Patent is hereby corrected as shown below:

Column 12

Table 5, "c/kg" should read --C/kg--.
Line 47, "As is" should read --In this embodiment,--.
Line 48, "in this embodiment" should be deleted.
Line 54, "c/kg" should read --C/kg--.
Line 55, "c/kg" should read --C/kg--.
Line 64, "similar conditions in" should read --conditions similar to--.
Line 65, "the" (second occurrence) should be deleted.

Column 13

Line 2, "of" should be deleted.
Line 4, "portion," should read --portion--.
Line 5, "of" (second occurrence) should read --in--.
Table 6, "c/kg" (both occurrences) should read --C/kg--.
Line 27, "The" should read --A--.
Line 33, "c/kg," should read --C/kg,--.
Line 34, "c/kg." should read --C/kg.--.
Line 35, "the" should read --an--.
Line 36, "The" should be deleted.
Line 37, "evaluations" should read --Evaluations--.
Line 56, "to" should read --on--.
Line 64, "c/kg" should read --C/kg--; and "c/kg." should read --C/kg.--.
Line 66, "of" should be deleted.
Line 68, "image," should read --image--

UNITED STATES PATENT AND TRADEMARK OFFICE

CERTIFICATE OF CORRECTION

PATENT NO. : 5,424,812 Page 8 of 9

DATED : June 13, 1995

INVENTOR(S) : KAZUHISA KEMMOCHI, ET AL.

It is certified that error appears in the above-indentified patent and that said Letters Patent is hereby corrected as shown below:

Column 14

Table 7, "c/kg" (both occurrences) should read --C/kg--.
Line 17, "significant" should read --significance--; and "FIG." should read --FIGS.--.
Line 18, "10 shows" should read --10A and 10B show--.
Line 19, "Figure," should read --figures,--.
Line 25, "(sec).in" should read --(sec) in--.
Line 27, "this" should read --this time--.

Column 15

Line 2, "the" (first occurrence) should read --then the--; and "dot" should read --dot phenomenon--.
Line 3, "the" (first occurrence) should be deleted.
Line 35, "c/kg" should read --C/kg--.
Line 36, "c/kg." should read --C/kg.--.
Line 40, "FIG. 9,(A)." should read --FIG. 9A.--.
Line 42, "of" should be deleted.
Line 44, "image," should read --image--.
Table 8, "c/kg" should read --C/kg--.
Line 62, "FIG.10," should read --FIGS. 10A and 10B,--.
Line 65, "the" should read --then the--.

UNITED STATES PATENT AND TRADEMARK OFFICE

CERTIFICATE OF CORRECTION

PATENT NO. : 5,424,812

DATED : June 13, 1995

INVENTOR(S) : KAZUHISA KEMMOCHI, ET AL.

It is certified that error appears in the above-indentified patent and that said Letters Patent is hereby corrected as shown below:

Column 16

Line 9, "uniform" should read --a uniform--.
Line 10, "the" should read --a--.
Line 22, "and therefore," should be deleted.
Line 26, "FIG. 9,(A)," should read --FIG. 9A,--.
Line 27, "FIG. 9,(B)," should read --FIG. 9B,--.
Line 29, "FIG. 9,(C)," should read --FIG. 9C,--.
Line 32, "Most" should read --The most--.

Column 17

Line 10, "intervals." should read --interval.--

Column 18

Line 6, "light spot" should read --a light spot--.

Signed and Sealed this

Thirty-first Day of October 1995

Bruce Lehman

*Attest:*

BRUCE LEHMAN

*Attesting Officer*

*Commissioner of Patents and Trademarks*